US005350126A

United States Patent [19]

Irikura

[11] Patent Number: 5,350,126

[45] Date of Patent: Sep. 27, 1994

[54] SHREDDING DEVICE FOR PAPER WEB USED IN THE MANUFACTURE OF CIGARETTES WITH FILTERS

[75] Inventor: Takayuki Irikura, Tokyo, Japan

[73] Assignee: Japan Tobacco, Inc., Tokyo, Japan

[21] Appl. No.: 88,422

[22] Filed: Jun. 23, 1993

[30] Foreign Application Priority Data

Jun. 24, 1992 [JP] Japan ..... 4-165877

[51] Int. Cl.[5] ..... B02C 1/08

[52] U.S. Cl. ..... 241/235; 241/230

[58] Field of Search ..... 241/230–233, 241/235, 101.2

[56] References Cited

U.S. PATENT DOCUMENTS 4,576,339 3/1986 Snyder et al. ..... 241/230 X

FOREIGN PATENT DOCUMENTS 61-54559 11/1986 Japan .

*Primary Examiner*—Douglas D. Watts

[57] ABSTRACT

A shredding device for paper web is equipped with a receiving drum, the peripheral surface thereof being formed as a suction surface, a bladed drum having a pair of free rollers which rotate in contact with the peripheral surface or the receiving drum. a pair of rocking arms which support the bladed drum and the pair of free rollers so that they are free to rock, and a pair of pressure springs which urge these rocking arms toward the receiving drum. The urging force of these pressure springs press the pair of free rollers against the peripheral surface of the receiving drum with a specified force.

8 Claims, 6 Drawing Sheets

SHREDDING DEVICE FOR PAPER WEB USED IN THE MANUFACTURE OF CIGARETTES WITH FILTERS

BACKGROUND OF THE INVENTION

Field of the Invention

The present invention relates to a shredding device which is incorporated in a filter attachment designed to connect cigarettes and filters and which shreds paper web to produce paper pieces used for connecting cigarettes and filters.

Description of Related Art

This type of filter attachment is provided with a non-contact type shredding device which is disclosed in the publication of examined JP patent application No. S61-54559. This publicly known shredding device includes a receiving drum and a bladed drum. The bladed drum has a plurality of shredding blades arranged equidistantly on its peripheral surface and a air of free rollers installed on its both ends. These free rollers have larger diameters than that of the bladed drum and they rotate while being in contact with the receiving drum.

With the receiving drum and the bladed drum being rotated in the opposite direction from each other, when a paper web is supplied between the receiving drum and the bladed drum, then passes through these drums, the shredding blades of the bladed drum shred the paper web into paper pieces of a specified length without contacting the peripheral surface of the receiving drum.

Thus, the shredding blades of the bladed drum do not collide with the receiving drum at the time of shredding the paper web, making it possible to prevent shredding noises caused by such a collision and also to prevent damage to the receiving drum or the shredding blades.

In the non-contact type shredding device described above, the shredding performance heavily depends on the size of the gap between the shredding blades and the receiving drum when the shredding blades approach most closely to the peripheral surface or the receiving drum.

Hence, to maintain the desired shredding performance, both drum shafts of the receiving drum and the bladed drum are urged by pressing screws in the directions that cause them to press toward each other. In other words, the pair of free rollers of the bladed drum are pressed and urged against the receiving drum by a predetermined force, thereby maintaining the gap at a constant dimension.

In recent years, however, the receiving drum, bladed drum, and free rollers are increasingly made larger to achieve higher speed operation of the aforementioned filter attachment. As these drums and rollers grow larger, it becomes extremely difficult to maintain the assembly accuracy of these parts.

Inadequate assembly accuracy will cause, for example, the run-out of the receiving drum. Such a run-out causes the gap to increase, making it impossible to shred the paper web or it may lead to a decreased gap, causing the shredding blades to bump against the receiving drum.

In addition, changes in the aforementioned gap involve forcible deformation of the bearings which support the drum shafts; therefore, deterioration from overheating of these bearings may result.

SUMMARY OF THE INVENTION

An object of the present invention is to provide a shredding device which is capable of maintaining paper web shredding performance for a long time and of ensuring prolonged service life thereof.

The above-mentioned object is achieved by a shredding device according to the present invention. The shredding device comprises the first drum which is rotated and which has a peripheral surface for carrying a paper web as the drum rotates, and shredding means for shredding the paper web into paper pieces of a specified length, in cooperation with the first drum, the shredding means including a second drum which is arranged close to and in parallel to the first drum and which is rotated in the opposite direction from the first drum, a pair of free rollers which are installed at both sides of the second drum coaxially with the second drum and which have a larger outside diameter than the second drum and rotate while contacting the peripheral surface of the first drum, a plurality of shredding blades which are provided circumferentially on the peripheral surface of the second drum at equal intervals and which pass the first drum with a predetermined gap between themselves and the peripheral surface of the first drum as the second drum is rotated, the shredding blades shredding the paper web on the first drum while passing, supporting means for supporting the second drum and the pair of free rollers to allow the second drum and the free rollers to move toward or away from the peripheral surface of the first drum, and an urging means for urging the second drum and the pair of free rollers toward the peripheral surface of the first drum, the free rollers being pressed against the peripheral surface of the first drum with a predetermined force.

According to the above-mentioned shredding device, the second drum and the pair of free rollers are supported by the supporting means so that they are allowed to move toward or away from the peripheral surface of the first drum and are constantly urged toward the peripheral surface of the first drum by the urging means. Accordingly, since the pair of free rollers having a larger outside diameter than the second drum rotate while being in contact with the peripheral surface of the first drum, the second drum rotates without causing the shredding blades to contact the peripheral surface of the first drum.

A paper web is supplied between the first drum and the second drum which are rotated in the opposite directions from each other. When the paper web passes through the drums, the paper web is cut into individual paper places by the shredding blades of the second drum.

Even if the rotation of the first rotary drum develops run-out while the above-mentioned paper web is being cut, the pair of free rollers change their position together with the second drum, following the run-out of the first drum. Hence, a constant gap is maintained between the shredding blades of the second drum and the peripheral surface of the first drum while the paper web is cutting, permitting stable cut of the paper web.

Also, since the above-mentioned gap is securely maintained, the shredding blades of the second drum do not collide with the peripheral surface of the first drum. As a result, it is possible to prevent the cutting noise and damage to the peripheral surface of the first drum and the shredding blades at the time of shredding the paper web.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will be better understood from the detailed description given herein below and the accompanying drawings which are given by way of illustration only, and thus, are not limitative of the present invention, and wherein.

DETAILED DESCRIPTION OF THE PREFERRED EMBODIMENTS

Figure 1:
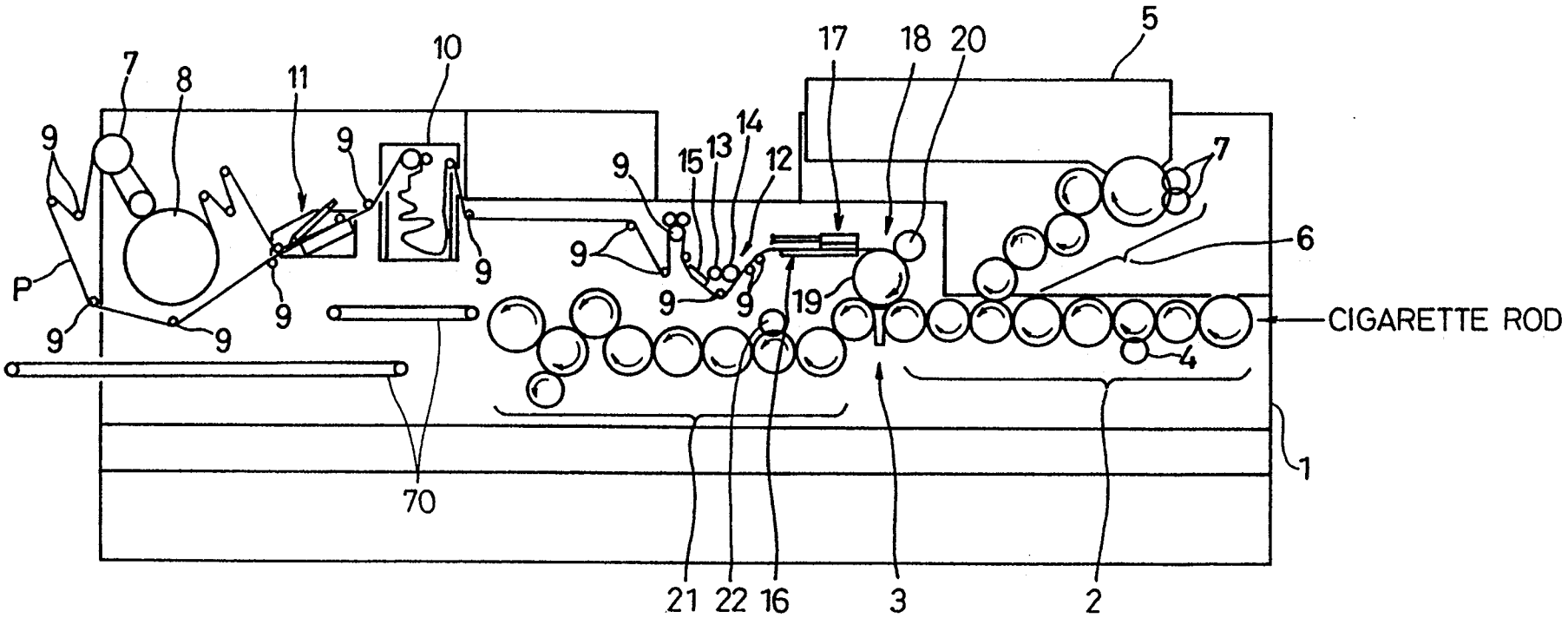
FIG. 1 is a schematic front view of a filter attachment.

As shown in FIG. 1, a filter attachment is equipped with a mainframe 1. A drum train 2 is provided on the right side of the mainframe 1. The drum train 2 extends to a rolling section 3 on the left as observed in FIG. 1.

The drum train 2 comprises many drums and the peripheral surface of each drum has many grooves (not shown) which are provided equidistantly. A cigarette rod produced by a cigarette manufacturing machine (not shown) is supplied to a groove of the grooved drum which is located at the right end of the drum train 2, the cigarette rod having a length which corresponds to a double length cigarette.

Cigarette rods supplied to the drum train 2 are successively transferred to the grooves of the grooved drums positioned at left by the rotating grooved drums of the drum train 2 as publicly known, thus being carried toward the rolling section 3. A grooved drum lying in the middle of the drum train 2 has a rotary knife 4 and the rotary knife 4 cuts a cigarette rod, which has been carried in, into individual cigarettes as the grooved drum rotates. After that, the two cigarettes, which have been acquired by cutting the single cigarette rod, are carried toward the above-mentioned rolling section 3. In the course of the carrying process, a predetermined space is provided between the two cigarettes.

Figure 2:
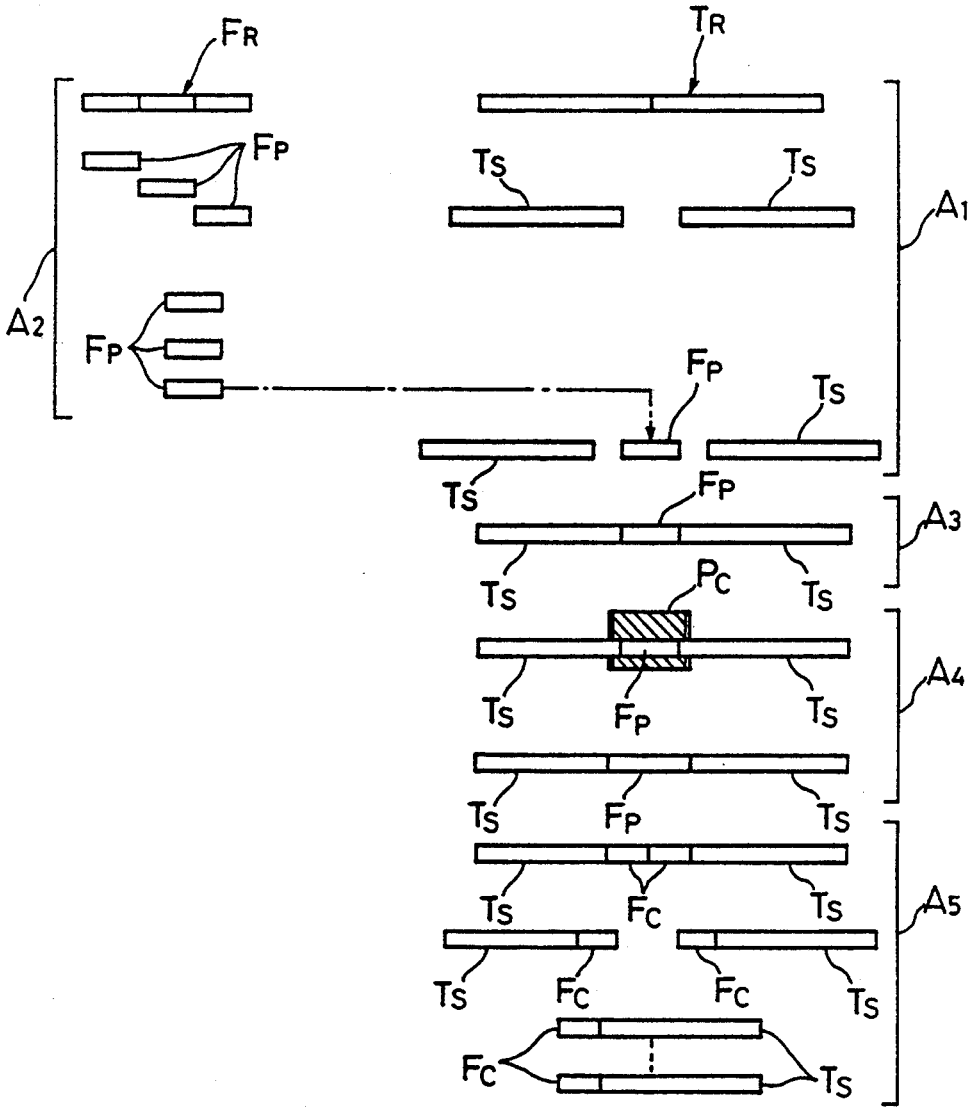
FIG. 2 shows a cigarette and filter rod processing flow in the filter attachment.

In FIG. 2, an area $A_1$ shows a processing flow from a step wherein individual cigarettes are formed from a cigarette rod to a step wherein the space is provided between the two cigarettes. In FIG. 2, a reference mark $T_R$ indicates the cigarette rod and a reference mark $T_s$ indicates the cigarettes.

As shown in FIG. 1, above the drum train 2 is provided a hopper 5. The hopper 5 contains many filter rods which are not shown. The hopper 5 and the drum train 2 are connected via a drum train 6 which is similar to the drum train 2.

The drum train 6 carries a filter rod, which has been taken out from the hopper 5, to the drum train 2. In the course of the carrying process. The filter rod is equally cut into filter plugs of a specified length, then the filter plugs are supplied between the cigarettes on the drum train 2.

More specifically, a grooved drum of the drum train 6 located right below the hopper 5 is equipped with, for example, two rotary knives 7. The rotary knives 7 equally cut a filter rod, which is carried in as the grooved drum rotates, into three filter plugs.

A grooved drum located downstream from the grooved drum with the rotary knives 7 functions as a "grading drum." The three filter plugs obtained from a single filter rod are placed one behind another in the carrying direction on the grading drum. Thus, the three filter plugs passing through the grading drum are fed to the drum train 2 one by one from the grooved drum located at the downstream end of the drum train 6.

Each of the filter plugs supplied to the drum train 2 is arranged between two cigarettes at the aforementioned space. After that, the filter plug is carried with the two cigarettes to the rolling section 3.

In FIG. 2, an area $A_2$ shows a processing flow from a step wherein individual filter plugs are acquired from a filter rod to a step wherein a filter plug is placed between the two cigarettes $T_s$. In FIG. 2, a reference mark $F_R$ indicates the filter rod and a reference mark $F_P$ Indicates the filter plug, the filter plug $F_P$ having a length which is equal to a double length filter chips, each filter chip being attached to one cigarette $T_s$.

On the drum train 2, the two cigarettes $T_s$ with the filter plug $F_P$ positioned between them are moved so that they come in close contact with both ends of the filter plug $F_e$ when they pass through the last grooved drum of the drum train 2. This processing is shown by an area $A_s$ in FIG. 2.

Hence, the two cigarettes $T_s$ are fed with the single filter plug $F_P$ from the drum train 2 to the rolling section 3.

On the other hand, a paper piece with glue on one surface thereof is also fed to the rolling section 3. The paper piece feeding system extends from the top left end of the mainframe 1 to the rolling section 3 in FIG. 1.

The feeding system has a pair of paper rolls 7 and 8 at the top left of the mainframe 1. These paper rolls 7 and 8 comprise reels wrapped with paper webs $P_w$ in multiple layers. The width of the paper web $P_w$ is sufficiently larger than the length of the filter plug $F_P$.

Under the condition shown in FIG. 1, the paper web $P_w$ is drawn out from the paper roll 7, and the drawn-out paper web $P_w$ is led to the rolling section 3 while it is guided by multiple guide rollers 9 which define the feeding route. In the middle of the feeding route, there is a reservoir 10 for the paper web $P_w$ on the side of the paper rolls 7 and 8. The reservoir 10 is used to absorb a difference between the consuming speed of the paper web $P_w$ on the rolling section 3 and the feeding-out speed of the paper web $P_w$ on the paper roll side when the filter attachment is shut down or to temporarily accumulate the paper web $P_w$ prior to the connection of the paper webs $P_w$.

The following describes the connection of the paper webs $P_w$. A connecting section 11 is provided on the upstream side of the reservoir 10. The leading end of the paper web $P_w$ drawn out from the other paper roll 8 is led to the connecting section 11 in advance. If the paper web $P_w$ is stored in the reservoir 10, when the paper web $P_w$ of the paper roll 7 is consumed and then the trailing end of the paper web $P_w$ reaches the connecting section 11, the drawing out of the paper web $P_w$ from the paper roll 7 is stopped, then the leading end of the paper web $P_w$ drawn out from tile paper roll 8 can be connected to the trailing end of the paper web $P_w$. Even while the connection is being performed, the paper web $P_w$ continues to be fed from the reservoir 10 to the rolling section 3.

In the feed path of the paper web $P_w$, a gluing device 12 is provided on the side of the rolling section 3. The gluing device 12 comprises an intermediate roller 13 which rotates while it is partially immersed in the glue of a glue container which is not shown, and a transfer roller 14 which rotates while being in contact with the intermediate roller 13 on one side and which rotates while being in contact with one surface of the paper web $P_w$ on the other side.

The glue which is applied from the glue container to the peripheral surface of the intermediate roller 13 is transferred from the intermediate roller 13 to the transfer roller 14. At this time, the glue is spread to a specified thickness and applied to the peripheral surface of the transfer roller 14 then it is transferred to one surface of the paper web $P_w$ from the transfer roller 14. The details of the gluing device 12 are disclosed in the publication of examined JP patent application No. S63-43077.

In the feeding route of the paper web $P_w$, there are a pre-heater 15 and a post-heater 16 with the gluing device 12 located between them. The preheater 15 and the post-heater 16 have guide plates for the paper web $P_w$ and heat-generating sheets attached to the surfaces of the guide plates, the guide plates and heat-generating sheets defining the carrying surface of the paper web $P_w$. As is obvious from FIG. 1, the pre-heater 15 heats the surface of the paper web $P_w$ to which the glue is applied, while the post-heater 16 heats the other surface of the paper web $P_w$.

In the case of this embodiment, the post-heater 16 is combined with a hot-air heater 17 which blows hot air to the glue applied to the paper web $P_w$, thus effectively pre-drying the glue of the paper web $P_w$.

A shredding device 18 is provided at the end of the feeding route of the paper web $P_w$. This shredding device 18 cuts the paper web $P_w$ with the glue into paper pieces of a specified length, then the paper pieces are fed to the rolling section 3.

The shredding degree 18 is equipped with a receiving drum 19, the peripheral surface of the receiving drum 19 being formed as a suction surface for suction of air from outside. In the vicinity of the receiving drum 19, there is a bladed drum 20, and these drums 19 and 20 are rotated at the same circumferential speed but in the opposite directions from each other.

When the paper web $P_w$ with the glue reaches the receiving drum 19, the surface of the paper web $P_w$ with no glue is sectioned to the suction surface of the receiving drum 19 and it is supplied to the rolling section 3 as the receiving drum 19 rotates. Although it is not shown in FIG. 1, the bladed drum 20 has a plurality of shredding blades installed circumferentially at equal intervals on its peripheral surface. Hence, the paper web $P_w$ sectioned to the peripheral surface of the receiving drum 19 passes between the receiving drum 19 and the bladed drum 20 as the receiving drum 19 rotates. At this time of passing, the paper web $P_w$ is cut into the paper pieces by the shredding blades of the rotating bladed drum 20. As a result, the paper pieces are formed on the receiving drum 19. After that, the individual paper pieces are supplied to the rolling section 3 in succession as the receiving drum 19 rotates with the paper places suctioned to the receiving drum 19.

When the two cigarettes $T_s$ are supplied with the filter plug $F_P$ from the end of the aforementioned drum train 2 to the rolling section 3, these cigarettes $T_s$ and the filter plug $F_P$ roll between the receiving drum 19 and the rolling section 3. Also, when a paper piece is supplied to the rolling section 3, the paper piece is attached to a section extending from the end of one cigarette $T_s$ to the end of the other cigarette $T_s$ with the filter plug $F_P$ between them, and the paper piece is wrapped around the cigarettes and the filter plug as the cigarettes and the filter plug rotate. As a result, the two cigarettes $T_s$ and the filter plug $F_P$ are interconnected by the ring-like paper piece, thus producing a double filler cigarette which is equivalent to two filter cigarettes. After that, the double filter cigarette is supplied from the rolling section 3 to a drum train 21. The drum train 21 extends toward the left end of the mainframe 1.

By the time the paper piece is glued onto the cigarettes $T_s$ and the filter plug $F_P$, the suction applied to the paper piece by the receiving drum 19 has, of course, been released.

An area $A_4$ in FIG. 2 shows a processing flow from the supply of a paper piece to the rolling section 3 to the wrapping of the paper piece. A reference mark $P_c$ indicates the paper piece, and the surface of the paper piece $P_c$ to which the glue has been applied is shown hatched.

After the double filter cigarette is supplied from the rolling section 3 to the drum train 21, it is carried on the grooved drums of the drum train 21. One of the grooved drums of the drum train 21 has a rotary knife 22. When the double filter cigarette with the filter plug passes through the rotary knife 22, the knife cuts the double filter cigarette at the middle of its filter plug. As a result, two cigarettes with filter chips or two filter cigarettes are obtained from the double filter cigarette on the drum train 21.

After that, the two filter cigarettes are transferred from the end of the drum train 21 to a conveyor unit 70. The conveyor unit 70 carries the filter cigarettes to a packing machine (not shown) in the next stage, the filter cigarettes being arranged in the same direction while they are being carried in the conveyor unit 70.

An area $A_5$ in FIG. 2 shows the processing flow from cutting the double filter cigarettes, to carrying them to the packing machine. In FIG. 2, a reference mark $F_c$ denotes the filter chip obtained by cutting the filter plug $F_P$.

Figure 3:
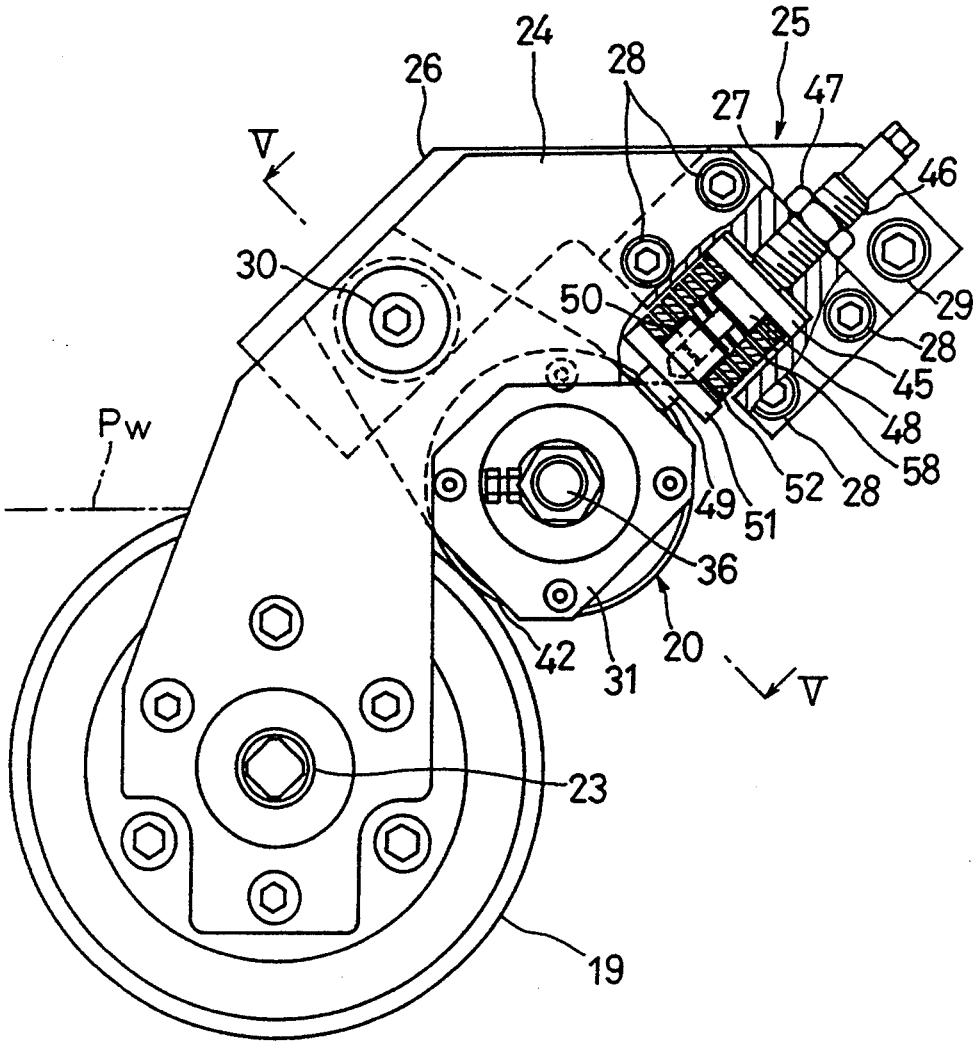
FIG. 3 is a front view of a shredding device in the filter attachment with a partial cutaway view.
Figure 4:
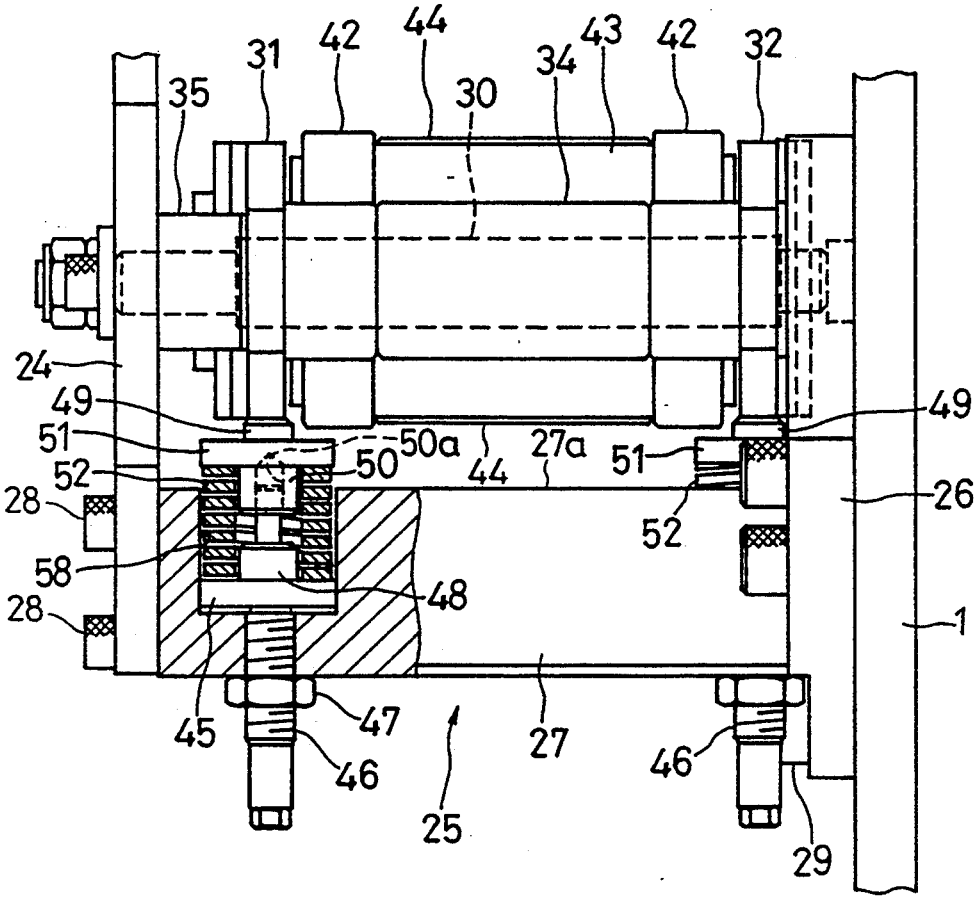
FIG. 4 is a top plan view of the shredding device of FIG. 3 with a partial cutaway view.
Figure 5:
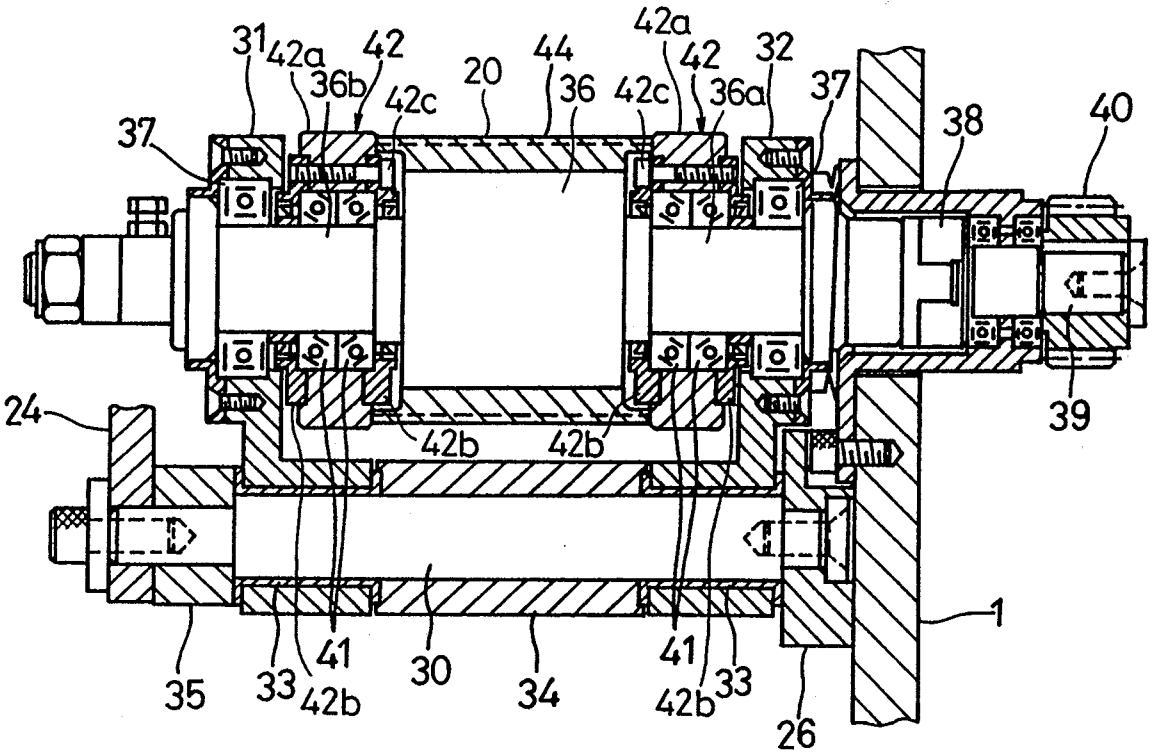
FIG. 5 is a cross-sectional view of the shredding device taken along the line V—V in FIG. 3.

Referring now to FIG. 3 through FIG. 5, the details of the aforementioned shredding device 18 are shown. The following describes the shredding device 18 in detail.

As shown in FIG. 3, the receiving drum 19 has a drum shaft 23, and one end of the drum shaft 23 is rotatably supported by the mainframe 1, while its other end is rotatably supported by the bottom section of a support arm 24. Although it is not shown, one end of the drum shaft 23 is connected to the driving source to receive power from the driving source so that the drum shaft 23, i.e., the receiving drum 19, is rotated in a specified direction.

The support arm 24 is shaped approximately like an upside-down "L," and it is obvious from FIG. 3 that it extends in parallel with the mainframe 1. The top end of the support arm 24 is fixed onto the mainframe 1 through a bracket 25. In other words, the bracket 25 is provided with a base plate 26 installed along the mainframe 1 and a shoulder block 27 which projects from one end of the base plate 26. The top end of the support arm 24 is fixed to the distal end of the shoulder block 27 via a plurality of connecting bolts 28.

On the other hand, the base plate 26 is fixed to the mainframe 1 via a plurality of connecting bolts 29. As is obvious from FIG. 3, the base plate 26 extends facing the upper portion of the support plate 24.

A rocking shaft 30 extends from one end of the base plate 26 to the central part of the support arm 24. The rocking shaft 30 extends in parallel to the drum shaft 23 of the receiving drum 19, both ends thereof being held by the support arm 24 and the base plate 26.

The rocking shaft 30 has a pair of rocking arms 31 and 32, and the upper ends of these arms 31 and 32 are supported by the rocking shaft 30 via plain bearings 33 as shown in FIG. 5 so that they can rotate. A spacer sleeve 34 is mounted on the rocking shaft 30 between the upper ends of the rocking arms 31 and 32, and further, a spacer ring 35 is mounted between the upper end of the rocking arm 31 and the support arm 24. Hence, the mounting positions of the rocking arms 31 and 32 in relation to the rocking shaft 30 are determined by the spacer sleeve 34 and the spacer ring 35.

A drum shaft 36 of the bladed drum 20 extends between the bottom ends of the rocking arms 31 and 32. The drum shaft 36 extends in parallel to the drum shaft 23 of the receiving drum 19, both ends thereof being rotatably supported by the bottom ends of the rocking arms 31 and 32 via bearings 37.

To be more specific, the drum shaft 36 has small-diameter portions **36*a* and 36*b* on both ends, these small-diameter portions 36*a* and 36*b* passing through the bottom ends of their corresponding rocking arms 31 and 32 via the bearings 37**.

The small-diameter portion **36*a* of the drum shaft 36, which is located on the side of the mainframe 1, penetrates the mainframe 1 via an Oldham coupling 38, the Oldham coupling 38 being supported by the mainframe 1**.

The small-diameter portion **36*a* penetrating the Oldham coupling 38 is connected to an input shaft 39. The input shaft 39 is provided with an input gear 40. Motive power is transmitted to the input gear 40** via a gear train which is not shown.

Hence, when the input gear 40, i.e., input shaft 39, is rotated, the driving force is transmitted to the drum shaft 36 via the Oldham coupling 38, thus causing the drum shaft 36 to rotate with the input shaft 39. The Oldham coupling 38 has a function that ensures transmission of the motive power from the input shaft 39 to the drum shaft 36 while making the input shaft 39 and drum shaft 36 run at the same rotational speed even if the rocking arms 31 and 32 rock and an axial disagreement occurs between the input shaft 39 and the drum shaft 36.

A pair of free rollers 42 are mounted on the small-diameter portions **36*a* and 36*b* of the drum shaft 36 via bearings 41 so that they can rotate. These free rollers 42 are located between the corresponding rocking arm and the large-diameter portion of the drum shaft 36**, respectively.

Each of the free rollers 42 includes a roller body **42*a* made of cemented carbide and ring holders 42*b* attached to both surfaces of the roller body 42*a* via screws 42*c* which penetrate the roller bodies 42*a*. Further, each holder ring 42*b* is supported by the drum shaft 36** via bearings so that they can rotate.

The portion of the drum shaft 36 located between the free rollers 42, i.e., the large-diameter portion of the drum shaft, is provided with the bladed drum 20, the bladed drum 20 rotating as one piece with the drum shaft 36. The bladed drum 20 is made of cemented carbide similar to that of the roller body **42*a* of the free roller 42, and a plurality of shredding blades 44 are provided on the peripheral surface of the bladed drum. These shredding blades 44 are arranged equidistantly on the periphery of the bladed drum 20, the blade edges extending in the axial direction of the drum shaft 36. The blade edge of each shredding blade 44 has a trapezoid section although it is not shown. The trapezoid shape is suited for shredding the paper web $P_w$ without contacting the receiving drum 19** as described in the aforementioned publication of examined JP patent application No. S61-54559.

The shoulder block 27 of the aforementioned bracket 25 incorporates a pair of urging mechanism for pressing the rocking arms 31 and 32, that is, a pair of the free rollers 42, against the peripheral surface of the receiving drum 19. The urging mechanisms share the same structure; therefore, the following explains about only one of the urging mechanisms.

The shoulder block 27 has a surface **27*a* which faces the bladed drum 20, the surface 27*a* having a bottomed hole 58. A slider 45 is fitted in the hole 58 so that it can slide, one end surface of the slider 45 facing the bottom surface of the hole 58, while the other end surface facing the open side of the hole 58**.

A threaded shaft 46 coaxially extends from one end surface of the slider 45; the threaded shaft 46 is screwed into the bottom surface of the hole 58 and it protrudes outside the shoulder block 27. The projection of the threaded shaft 46 has a nut 47 which determines the axial position of the slider 45 in the hole 58.

A guide shaft 48 coaxially extends from the other end surface of the slider 45, while a pusher 49 is provided on the open side of the hole 58. The pusher 49 has a shaft 50 on the side of the hole 58, the shaft 50 having a guide hole **50*a*. The guide shaft 48 of the slider 45 is slidably fitted into the guide hole 50*a* of the pusher 49, the pusher 49 thus being supported by the slider 45**.

The pusher 49 has a flange 51, and between the flange 51 and the slider 45 is provided a compression coil spring, i.e., a pressure spring 52, which surrounds the guide shaft 48 and the shaft 50. The pressure spring 52 presses the pusher 49 against the rocking arm 31 with a specified pressing force. The pressing force can be adjusted by loosening the nut 47 and changing the axial position of the threaded shaft 46.

In FIG. 4, although the other urging mechanism is only partially shown, the pusher 49 of the urging mechanism also urges the rocking arm 32 with a specified pressing force.

As described above, the pushers 49 apply pressure to the rocking arms 31 and 32, causing the rocking arms 31 and 32 to be urged to turn in the direction toward the receiving drum 19. As a result, the pair of free rollers 42 are kept in contact with the peripheral surface of the receiving drum 19 with the specified pressing force.

The pair of free rollers 42 has an outside diameter which is slightly larger than the outside diameter of the bladed drum 20, i.e., the outside diameter of the rotational trajectory of the blade edges of the shredding blades 44. Hence, when the pair of free rollers 42 rotate while being in contact with the receiving drum 19, the shredding blades 44 do not touch the peripheral surface of the receiving drum 19 even when the receiving drum 19 and the bladed drum 20 are rotated in opposite directions from each other. In other words, even when the shredding blades 44 come closest to the peripheral surface of the receiving drum 19, a gap (not shown) is secured between the peripheral surface of the receiving drum 19 and the edges of the shredding blades 44, the gap being sufficiently smaller than the thickness of the paper web $P_w$.

According to the shredding device described above, while the receiving drum 19 and the bladed drum 20 are rotating, the paper web $P_w$ is supplied between the receiving drum 19 and the bladed drum 20, then when the paper web $P_w$ passes between the drums 19 and 20, it is cut into paper pieces $P_c$ of a specified length by the wedge effect of the blade edges of the shredding blades 44. After that, the paper pieces $P_c$ are supplied to the rolling section 3 as previously described.

Since the foregoing gap is secured between the shredding blades 44 of the bladed drum 20 and the peripheral surface of the receiving drum 19 when the paper web $P_w$ is cut, the shredding blades 44 do not bump against the receiving drum 19, making it possible to prevent noises from the cutting or damage to the shredding blades 44 or the peripheral surface of the receiving drum 19.

As previously described, the pair of rocking arms 31 and 32 are constantly urged by the pressure springs 52 of the urging mechanisms toward the receiving drum 19. Accordingly, even if the rotation of the receiving drum 19 develops run-out while the paper web $P_w$ is being cut, the pair of free rollers 42 do not come apart from the peripheral surface of the receiving drum 19. In other words, the rocking position of the rocking arms 31 and 32 changes in response to the run-out of the rotation of the receiving drum 19; therefore, the pair of rotating free rollers 42 are maintained securely in contact with the peripheral surface of the receiving drum 19.

Thus, since the free rollers 42 and the bladed drum 20 are mounted on the drum shaft 36 common to them, the gap between the shredding blades 44 of the bladed drum 20 and the peripheral surface of the receiving drum 19 is maintained at the constant dimension at all times during the cutting process. As a result, the paper web $P_w$ is cut reliably and stably.

Furthermore, even if the rotation of the receiving drum 19 incurs run-out, the aforementioned gap is securely maintained, and therefore, the shredding blades 44 of the bladed drum 20 do not bump against the receiving drum 19, thus preventing damage to the blade edges of these shredding blades 44.

Also, the rocking arms 31 and 32 can rock, so that no excess force is applied to the bearings of the free rollers 42 and the receiving drum 19, thus protecting these bearings from deformation or deterioration due to overheat.

Figure 6:
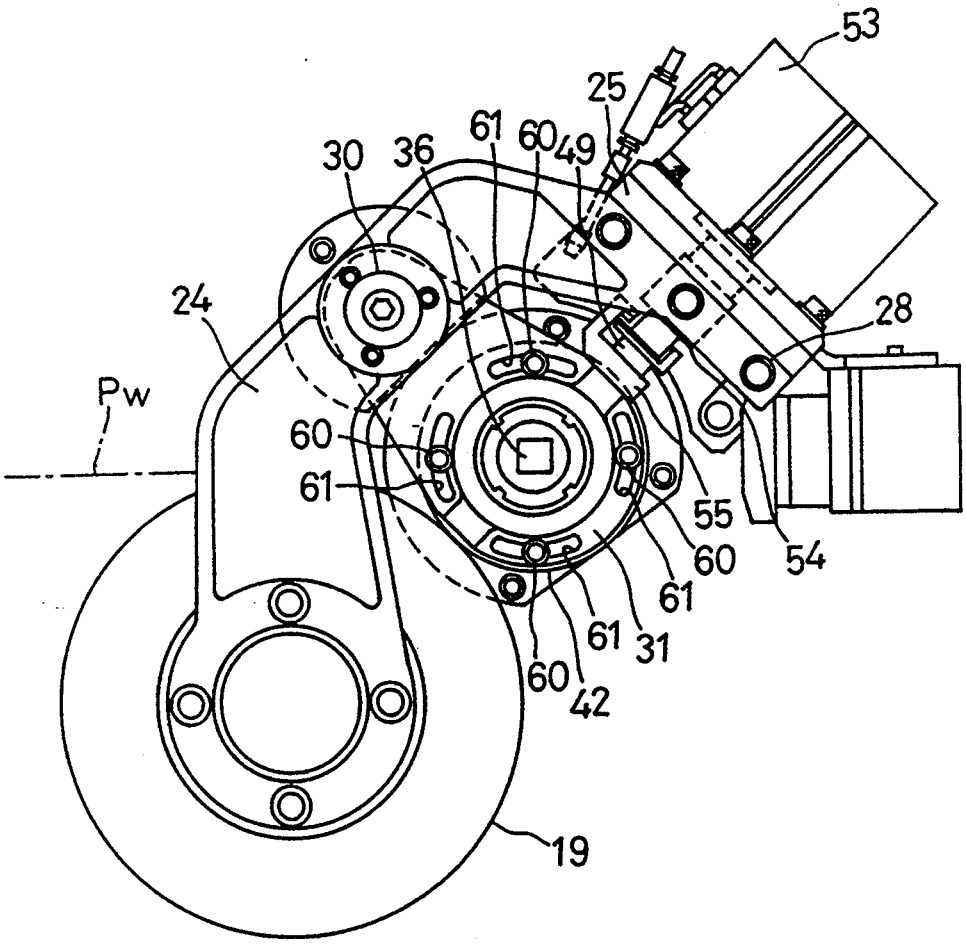
FIG. 6 is a front view showing a modification of the shredding device.
Figure 7:
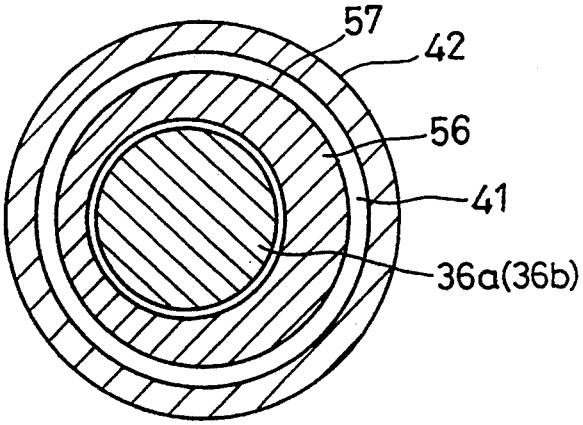
FIG. 7 is a cross-sectional view which shows a modification of the shredding device.

Referring to FIG. 6 and FIG. 7, a modification of the shredding device is shown. To explain about the shredding device according to the modification, the same reference numbers are given to the components and portions which have the same functions as those in the previous embodiment, thus omitting the description of the components and portions. The following describes only the points which differ from the aforementioned embodiment.

In the shredding device of the modification, the urging mechanism is equipped with an air cylinder 53 in place of the pressure spring 52 as shown in FIG. 6, and the pusher 49 is installed on the end of a piston rod 54 of the air cylinder 53. In the case of this modification, the pusher 49 is in contact with the corresponding rocking arm 31 via a plate member 55.

Thus, even when the air cylinder 53 is used in place of the pressure spring 52, the air cylinder 53 urges the corresponding rocking arm in the same manner toward the receiving drum 19. Hence, the shredding device of the modification also has the same advantages as the shredding device of the embodiment.

The bearing 41 of each free roller 42 is installed directly to the small-diameter portions **36*a* and 36*b* of the drum shaft 36 but via an eccentric ring 56 as shown in FIG. 7**.

The peripheral surface of the eccentric ring 56 is formed as a mounting surface 57 for the bearing 41 and it is eccentric to the drum shaft 36. An annular gap 70 is secured between the eccentric ring 56 and the small-diameter portion of the drum shaft 36. The gap prevents the eccentric ring 56 from being rotated even when the drum shaft 36 is rotated.

The eccentric ring 56 is mounted on the corresponding rocking arm so that its angular position can be adjusted in relation to the drum shaft 36. To be more specific, the eccentric ring 56 is installed on the corresponding rocking arm by four mounting bolts 60 shown in FIG. 6. All mounting bolts 60 are screwed into the eccentric ring 56, penetrating arc slots 61 formed in the rocking arm.

By changing the angular position of the eccentric ring 56, the distance from the point of contact between the receiving drum 19 and the free rollers 42 to the axis of the drum shaft 36 can be changed. Accordingly, even if the aforementioned gap decreases due to worn free rollers 42, the gap can be readjusted to a desired value simply by adjusting the angular position of the eccentric ring 56 in relation to the drum shaft 36. Also, even if the aforementioned gap increases due to ground shredding blades 44 of the bladed drum 20, the gap can be maintained at a constant value by adjusting the angular position of the eccentric ring 56.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A shredding device for a paper web used in the manufacture of cigarettes with filters, comprising:

a first drum rotatably arranged and having a peripheral surface for carrying the paper web as the drum rotates; and shredding means for shredding the paper web into paper pieces of a specified length in cooperation with said first drum, said shredding means including a first shaft arranged in parallel to said first drum, said first shaft being rotated in the opposite direction from said first drum, a second drum mounted on said first shaft and having a peripheral surface, said second drum being rotated with said first shaft, a pair of free rollers rotatably mounted on said first shaft at both sides of said second drum and having a larger outside diameter than said second drum, said pair of free rollers being rotated while contacting the peripheral surface of said first drum as said first drum rotates, a plurality of shredding blades arranged circumferentially on the peripheral surface of said second drum at equal intervals, said shredding blades passing said first drum with a specified gap between themselves and the peripheral surface of said first drum as said second drum is rotated, and shredding the paper web on said first drum while passing, supporting means for supporting said second drum and the pair of rollers so that they are allowed to move toward or away from the peripheral surface of said first drum, the supporting means includes a second shaft which is generally parallel to the first shaft, the second shaft being fixed, the supporting means further includes a pair of supporting arms rotatably supported on the second shaft, said first shaft being rotatably supported by the supporting arms, and urging means for urging said second drum and said pair of free rollers toward the peripheral surface of said first drum and pressing the pair of free rollers against the peripheral surface of the first drum with a specified force.

2. The device according to claim 1, wherein said urging means includes a pair of pushers, which are in contact with the supporting arms, and a pair of pressure springs pressing the support arms toward said first drum by means of the corresponding pusher.

3. The device according to claim 2, wherein said urging means further includes adjusting means for adjusting the urging force of the pressure springs.

4. The device according to claim 1, wherein said urging means includes a pair of pushers, which are in contact with the supporting arms, and a pair of air cylinders pressing the supporting arms toward said first drum by means of the corresponding pusher.

5. The device according to claim 1, wherein said device further includes an Oldham coupling connected to one end of said first shaft to transmit motive power to said common shaft.

6. The device according to claim 1, wherein said supporting means further includes eccentric rings eccentrically surrounding said first shaft and are fixed to its corresponding supporting arm, and bearings mounted on the eccentric rings, respectively, said pair of free rollers being rotatably supported on the bearings.

7. The device according to claim 6, wherein said supporting means further includes an annular gap defined between said first shaft and the eccentric ring.

8. The device according to claim 7, wherein said supporting means further includes adjusting means for adjusting a angular position of the eccentric ring in relation to said first shaft.

* * * * *